US006488442B2

(12) United States Patent
Boudreaux, Sr.

(10) Patent No.: US 6,488,442 B2
(45) Date of Patent: Dec. 3, 2002

(54) CONCRETE LEVELING DEVICE

(76) Inventor: Kurt J. Boudreaux, Sr., 684 Aragon Rd., Montegut, LA (US) 70377

( * ) Notice: Subject to any disclaimer, the term of this patent is extended or adjusted under 35 U.S.C. 154(b) by 0 days.

(21) Appl. No.: 09/758,116

(22) Filed: Jan. 11, 2001

(65) Prior Publication Data

US 2002/0090264 A1 Jul. 11, 2002

Related U.S. Application Data

(63) Continuation-in-part of application No. 09/232,548, filed on Jan. 18, 1999, now abandoned.

(51) Int. Cl.[7] ..... E01C 19/22
(52) U.S. Cl. ..... 404/97; 404/118
(58) Field of Search ..... 404/96, 97, 118, 404/119

(56) References Cited

U.S. PATENT DOCUMENTS

| | | | | | |
|---|---|---|---|---|---|
| 1,220,986 | A | | 3/1917 | Henderson | |
| 1,234,984 | A | * | 7/1917 | Walker | 404/118 |
| 2,155,571 | A | | 4/1939 | Tullis | |
| 2,813,466 | A | | 11/1957 | Togerson | |
| 4,397,581 | A | | 8/1983 | Jarvis | |
| 4,520,527 | A | | 6/1985 | Maggio et al. | |
| 4,702,641 | A | | 10/1987 | Naser et al. | |
| 5,016,319 | A | * | 5/1991 | Stigen | 14/114 |
| 5,115,536 | A | | 5/1992 | Jarvis | |
| 5,160,748 | A | | 11/1992 | Gauuan | |
| 5,324,085 | A | * | 6/1994 | Hintz, Jr. | 294/16 |
| 5,406,671 | A | * | 4/1995 | Green | 15/235.5 |
| 5,467,496 | A | | 11/1995 | Jarvis | |
| 5,468,095 | A | * | 11/1995 | Dawson | 404/118 |
| 5,605,415 | A | | 2/1997 | Shamblin | |
| 5,609,437 | A | * | 3/1997 | Silva | 404/118 |
| 5,687,448 | A | | 11/1997 | Dye, Jr. | |
| 5,807,022 | A | * | 9/1998 | McCleary | 404/97 |
| 5,980,154 | A | * | 11/1999 | Record | 404/97 |

* cited by examiner

*Primary Examiner*—Thomas B. Will
*Assistant Examiner*—Raymond W. Addie
(74) *Attorney, Agent, or Firm*—Kenneth L Tolar

(57) ABSTRACT

A device that allows a user to spread and level concrete in a standing position includes a beam formed of a pair of beam segments, each having an inboard end that may be removably joined to the inboard end of the opposing beam member at select locations to vary the length of the beam. Pivotally mounted to the outboard end of each beam segment is a handle assembly. The handle assembly is pivotable between a plurality of angular positions allowing the beam to be manipulated within confined spaces and whereby the beam may also be used in an inverted position. A first beam segment includes an eye bolt for coupling with an external towing device to assist a user in pulling the beam across a heavy layer of concrete.

6 Claims, 3 Drawing Sheets

CONCRETE LEVELING DEVICE

BACKGROUND OF THE INVENTION

This application is a continuation in part of application Ser. No. 09/232,548 filed Jan. 18, 1999 now abandoned. The invention relates to a device that allows one or more workers to spread and level concrete from a standing position.

DESCRIPTION OF THE PRIOR ART

When concrete foundations, walkways or driveways are poured, the concrete pile must be immediately spread, leveled and finished. Typically, the leveling and smoothing process is performed with floats, screeds and a handheld trowel. Initially, the concrete pile is spread and leveled with an elongated board or plank. Such a task is strenuous and cumbersome since two workers must each grasp an end of the board and pull it across the concrete while in a kneeling, bending or seated position. Furthermore, manually spreading heavier concrete is often too strenuous for two workers.

The present invention overcomes the above enumerated problems of conventional leveling and finishing tools by providing a device that allows a user to level and smooth concrete while standing. Furthermore, the device includes an upwardly extending handle at each end allowing a pair of workers to pull the device across a pile of concrete while standing. The device is also adapted so that a winch cable or similar towing means may be secured thereto to assist the workers in spreading heavier concrete.

Although at least two devices exist in the prior art for leveling concrete in a standing position, such devices do not include all of the features and benefits afforded by the present invention. For example, U.S. Pat. No. 1,220,986 issued to Henderson relates to a tamper and templet for concrete work comprising an elongated plate secured to the lower surface of a body. The plate is slightly arcuate so as to form a crown in a roadway when the device is pulled across the asphalt. A handle angularly extends from each end of the plate.

U.S. Pat. No. 2,155,571 issued to Tullis relates to a float for striking off and finishing the surface of concrete pavements comprising a heavy sheet metal channel having upturned flanges at its lateral margins. The device includes handles at each end which are angularly adjustable.

Although at least two concrete or asphalt finishing devices exist in the prior art, both of which allow a user to smooth concrete in a standing position, these devices have numerous disadvantages. Neither of the above described devices are length adjustable for leveling various size slabs. Additionally, although both devices include a pivotable handle at each end, the handles are pivotable within a narrow range preventing either device from being manipulated within narrow spaces or corners. Furthermore, because only one side of either of the above described devices may be used as a leveling surface, the device must be cleaned more frequently. Finally, the prior art devices are not equipped to be used with external towing means according to the present invention.

SUMMARY OF THE INVENTION

The present invention relates to a device for spreading and leveling concrete comprising an elongated beam formed of a pair of elongated beam segments, each having an inboard end and an outboard end. Each beam segment includes a plurality of apertures along substantially its entire length for receiving a fastener means to join the inboard ends at select positions to vary the length of the beam depending upon the size of the slab being poured. The outboard end of each beam segment includes a handle assembly pivotally mounted thereto which may be pivoted between a plurality of angular positions. One of the beam segments includes a latch means to which an external towing device such as a come-along or winch cable may be attached. It is therefore an object of the present invention to provide an adjustable length device for leveling various size concrete slabs.

It is another object of the present invention to provide a device for leveling concrete having handles at each end that are pivotable within a wide range allowing the device to be used in an inverted position while also allowing the leveling device to be manipulated within narrow or confined areas.

It is yet another object of the present invention to provide a device for leveling concrete adapted to be used with an external towing device. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
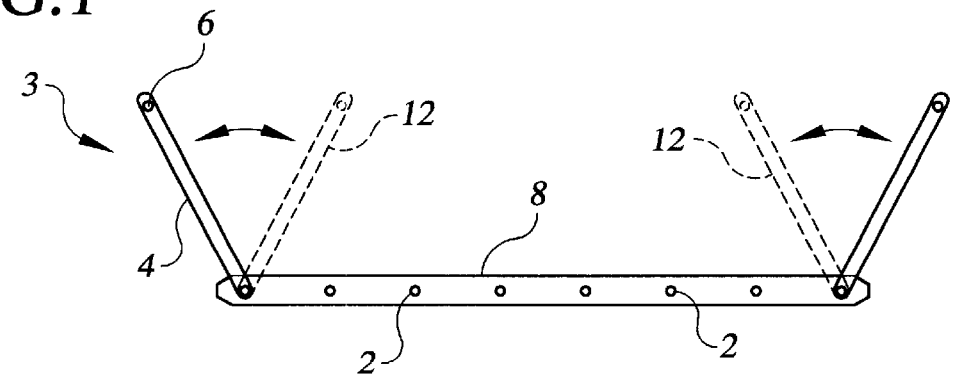
FIG. 1 is a side view of the inventive device depicting the handle assemblies in a first position with the handles in a second position depicted in phantom.
Figure 2:
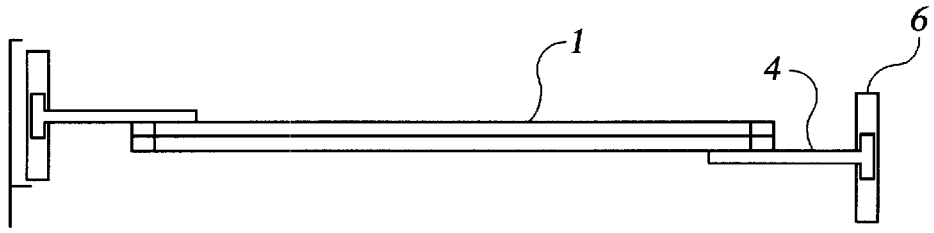
FIG. 2 depicts a top view of the inventive device.
Figure 3:
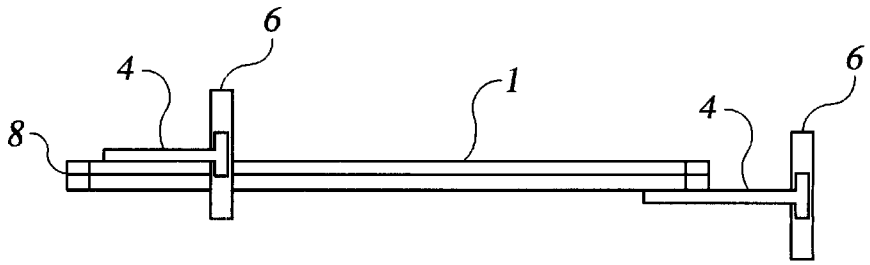
FIG. 3 depicts a top view of the inventive device with a handle pivoted to an inwardly extending position.
Figure 4:
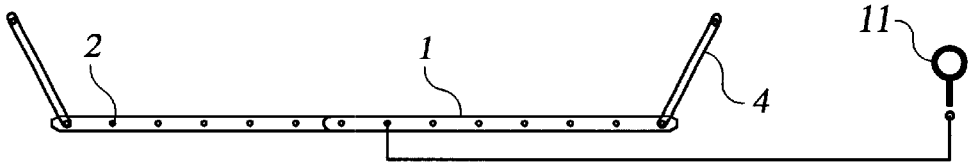
FIG. 4 is a side view of the inventive device with the beam in an extended position.
Figure 5:
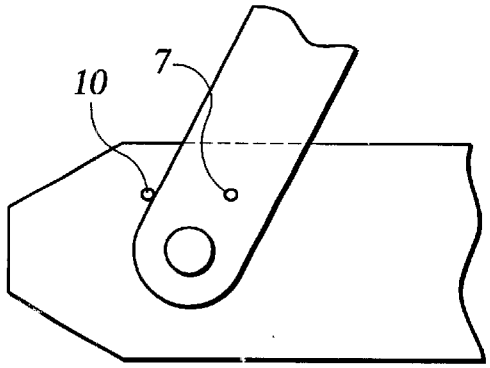
FIG. 5 is a detailed view of a handle arm pivotally mounted to a beam.
Figure 6:
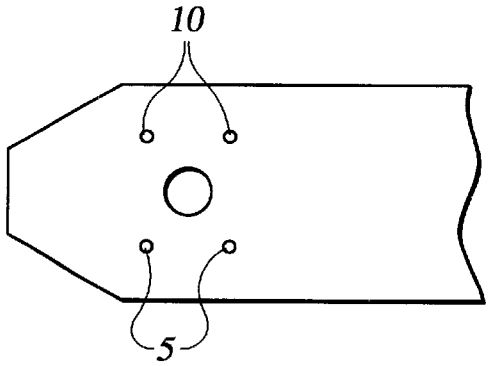
FIG. 6 is a close-up view of a distal end of a beam.

Referring now to FIGS. 1 through 5, the present invention relates to a device for spreading and leveling concrete. The device comprises a beam 8 formed of a pair of elongated beam segments 1 each having an inboard and an outboard end with the inboard ends being removably coupled. Each beam segment includes a plurality of apertures 2 along substantially its entire length. One or more apertures on the first segment is aligned with one or more apertures on the second segment and a fastener means such as a pin or quick release bolt is inserted through one set of the aligned apertures to fix the beam at a desired length. The upper and lower surfaces of each beam segment are substantially smooth and planar so as to create a flat, smooth surface when pulled across a layer of wet cement or concrete.

Pivotally mounted to the outboard end of each beam segment is a handle assembly 3. Each handle assembly includes an arm 4 having two opposing ends with a first end pivotally joined to the corresponding beam section. The arm is preferably coupled with the beam using pins, quick release bolts or similar means allowing the device to be dismantled for cleaning or storage. Attached to the opposing end of the arm is a transverse tubular handle member 6. The handle member includes an outer layer made from rubber or a similar suitable material. The arm has sufficient length to allow a user to stand and comfortably grasp the handle while the beam is resting on a pile of concrete. Furthermore, each transverse handle member is rotatably secured to the arm with a yoke or similar conventional assembly allowing the handle to pivot or rotate relative to the arm. The outboard end of each beam segment is contoured and includes a top pair 10 and a bottom pair 5 of apertures, each of which may be selectively aligned with an aperture 7 on the handle assembly arm 4 for receiving the locking pin, a quick release bolt or asimilar fastener means. Preferably, the arms are attached to outwardly facing sides of the beam segments so that they do not interfere with the collapsing of the beam. Accordingly, each handle assembly may be pivoted between an inwardly directed 12 and outwardly directed position to allow a user to manipulate an end of the beam assembly within confined spaces or comers. Furthermore, the top and bottom set of apertures allow each arm to pivot in a substantially 360 degree range. So that the beam may be inverted whereby the upper surface of the beam may also be used as a leveling or smoothing surface. Therefore, if the bottom surface of the beam becomes unusable due to concrete accumulation, a worker simply inverts the beam, pivots the handle assemblies downwardly and continues spreading the concrete. In addition, the handles may be rotated relative to the arms while the arms are pivoted to a position parallel with the beam segments allowing the device to be collapsed for storage.

One of the beam segments includes a latch means 11 such as a hook member or eye bolt removably received within one of its apertures to which an external towing device may be attached. The external towing device may include a winch or come-a-long driven cable, strap or similar apparatus. Accordingly, the external towing device may be used to assist a worker in pulling the beam across extremely heavy concrete.

Figure 7:
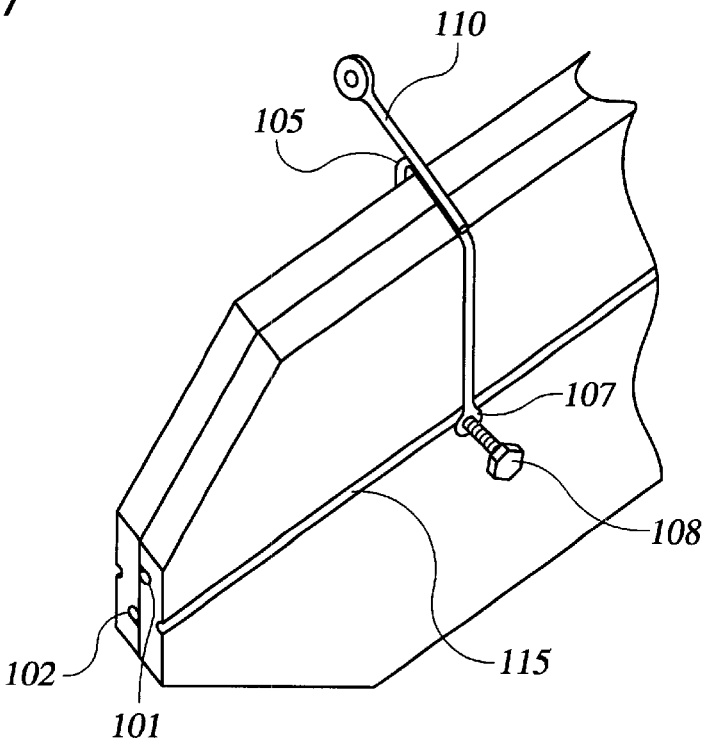
FIG. 7 is a perspective view of a second embodiment.
Figure 8:
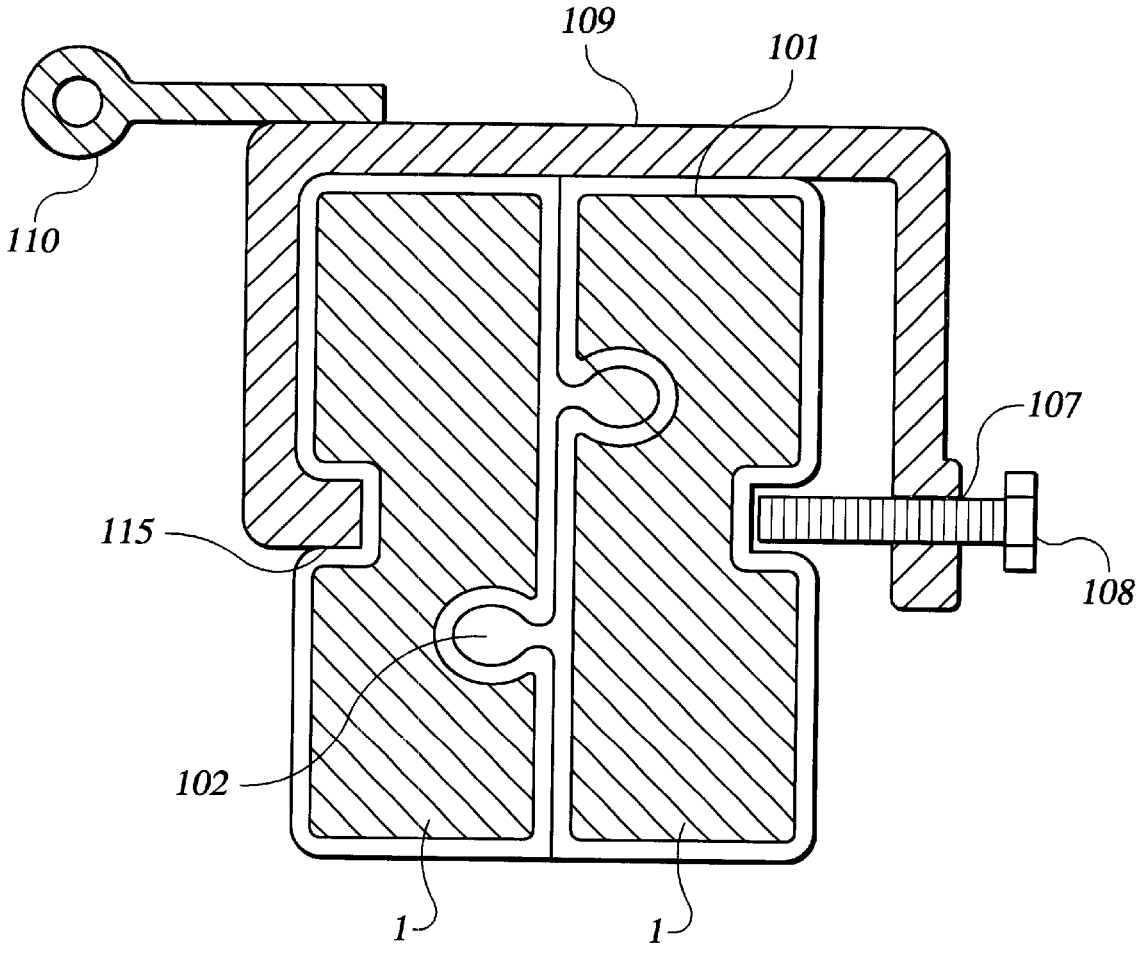
FIG. 8 is a cross-sectional view of the second embodiment.

Now referring to FIGS. 7 and 8, a second embodiment is depicted. In the second embodiment, each beam segment includes an inwardly facing side and an outwardly facing side, an upper surface and a lower surface. On the inwardly facing side of each beam segment is at least one longitudinal groove 101 and at least one similarly configured longitudinal tongue 102. Each tongue is slidably received within a groove on the adjacent beam section whereby each beam section is conveniently movable relative to the adjacent section to vary the overall length of the beam.

Surrounding the beam sections is a substantially C-shaped clamp 105 member having an inwardly directed terminal end that fits within a channel 115 on an outwardly facing side of one of the beam sections. The clamp member also includes a second end having a threaded eyelet 107 thereon that receives an elongated threaded bolt 108 which can be tightened within the elongated channel 115 on the outwardly facing side of the other beam section. Accordingly, a user can loosen the bolt and slide the beams sections until the beam is at a desired length. The bolt is then tightened within the channel to fix the beam at the desired length.

The clamp also includes a horizontal upper portion 109 that rests against the upper surfaces of the beam sections. A latch means 110 such as a hook or eyebolt is fastened to the upper portion of the clamp to which a wench, come-along cable or similar apparatus can be secured to assist the working in pulling the beam across particularly heavy piles of concrete.

The beam segments and handle assemblies according to the present invention are preferably constructed with aluminum, steel or a similar equivalent. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A device for spreading leveling concrete comprising:

an elongated length adjustable beam, said beam having two opposing ends, a substantially planar lower surface and a substantially planar upper surface whereby both the upper and lower surfaces provide a smooth surface to level a pile of concrete; said length adjustable beam formed of first and second beam segments, each having an outwardly facing side, an inwardly facing side, an inboard end and an outboard end, each of said beam segments further including at least one longitudinal groove and at least one longitudinal tongue on the inwardly facing side, said tongue and groove extending along substantially the entire length of said beam section, each tongue on one of said sections slidably received within the groove on the other of said beam sections whereby the length of said beam is variable by sliding the first beam section relative to the second beam section;

a clamping means for fixing said beam at a select length;

a handle assembly pivotally attached to the outboard end of each beam segment, each handle assembly pivotable towards and away from the inboard ends of said beam segments allowing each outboard end of said beam segment to be manipulated within confined spaces and to allow the beam to be used in an inverted position.

2. The device according to claim 1 wherein said clamping means includes a substantially C-shaped clamp mounted about said beam segments, said clamp having an inwardly turned first end received within a longitudinal channel on the outwardly facing side of said first beam section and a second end having a fastener means secured thereto, said fastener means securable within a longitudinal channel on the outwardly facing side of said second beam section to fix said beam sections at the select length.

3. The device according to claim 1 wherein said arms of pivotable within a substantially 360 degree range.

4. The device according to claim 2 wherein said clamp member includes a latch thereon to which an external towing apparatus is attached to assist a user in pulling device across a heavy layer of concrete.

5. The device according to claim 1 wherein said handle assemblies each include an elongated arm having two ends with a first end pivotally coupled with one of said beam segments, said handle assembly further including a handle member at the other end of said arm.

6. The device according to claim 5 wherein each of said handle assemblies is rotatably coupled to said arm so that said handle does not interfere with the rotation of said arm.

* * * * *